US010815647B2

(12) United States Patent
Chioccola

(10) Patent No.: US 10,815,647 B2
(45) Date of Patent: Oct. 27, 2020

(54) HYDRAULIC POWER CONTROL CIRCUIT AND CONSTRUCTION VEHICLE COMPRISING SUCH CIRCUIT

(71) Applicant: CNH Industrial America LLC, New Holland, PA (US)

(72) Inventor: Francesco Chioccola, Settimo Torinese (IT)

(73) Assignee: CNH Industrial America LLC, New Holland, PA (US)

( * ) Notice: Subject to any disclaimer, the term of this patent is extended or adjusted under 35 U.S.C. 154(b) by 277 days.

(21) Appl. No.: 16/093,648

(22) PCT Filed: Apr. 12, 2017

(86) PCT No.: PCT/EP2017/058832
§ 371 (c)(1),
(2) Date: Oct. 14, 2018

(87) PCT Pub. No.: WO2017/178546
PCT Pub. Date: Oct. 19, 2017

(65) Prior Publication Data

US 2019/0136490 A1 May 9, 2019

(30) Foreign Application Priority Data

Apr. 14, 2016 (IT) ..... UA2016A002611

(51) Int. Cl.
*F15B 11/16* (2006.01)
*E02F 9/22* (2006.01)

(52) U.S. Cl.
CPC ..... *E02F 9/2235* (2013.01); *E02F 9/2225* (2013.01); *E02F 9/2267* (2013.01);
(Continued)

(58) Field of Classification Search
CPC ..... F15B 11/163; F15B 2211/3111; F15B 2211/3116; F15B 2211/30525;
(Continued)

(56) References Cited

U.S. PATENT DOCUMENTS 5,806,312 A * 9/1998 Kauss ..... E02F 9/2232 137/596
9,133,605 B2 * 9/2015 Pomeroy ..... E02F 9/2235
(Continued)

FOREIGN PATENT DOCUMENTS

DE 19647994 A1 5/1998
DE 102012220863 A1 5/2014
(Continued)

*Primary Examiner* — Thomas E Lazo
(74) *Attorney, Agent, or Firm* — Peter Zacharias; Patrick Sheldrake

(57) ABSTRACT

In a load sensing hydraulic control circuit, a pressure compensator elaborates both a load sensing pressure signal to control a pump unit and a pressure compensated power flow for actuators, the power flow being either split or alternatively directed to at least a first and a second actuator control valves so that a differential pressure across the first and second control valves is controlled by the pressure compensator. In one embodiment, the circuit is onboard a construction vehicle to power actuators such is travel left, travel right, swing, boom, arm, bucket and the like.

14 Claims, 10 Drawing Sheets

(52) U.S. Cl.
CPC ..... *E02F 9/2296* (2013.01); *F15B 11/163* (2013.01); *F15B 2211/30525* (2013.01); *F15B 2211/30555* (2013.01); *F15B 2211/3105* (2013.01); *F15B 2211/3111* (2013.01); *F15B 2211/3116* (2013.01); *F15B 2211/71* (2013.01); *F15B 2211/78* (2013.01); *F15B 2211/781* (2013.01)

(58) Field of Classification Search
CPC ..... F15B 2211/78; F15B 2211/3105; F15B 2211/30555; F15B 2211/71; F15B 2211/40569; E02F 9/2235; E02F 9/2225; E02F 9/2267
See application file for complete search history.

(56) References Cited

U.S. PATENT DOCUMENTS

| | | | | |
|---|---|---|---|---|
| 9,140,275 | B2 * | 9/2015 | Dengler | F16H 61/4078 |
| 10,655,648 | B2 * | 5/2020 | Busani | F15B 11/055 |
| 2002/0134079 | A1 * | 9/2002 | Fillon | F15B 11/163 60/422 |
| 2013/0220425 | A1 | 8/2013 | Pomeroy et al. | |
| 2019/0161328 | A1 * | 5/2019 | Sutar | B66F 7/08 |

FOREIGN PATENT DOCUMENTS

| | | | |
|---|---|---|---|
| DE | 102013017093 | A1 | 4/2015 |
| JP | H11315806 | A | 11/1999 |

* cited by examiner

HYDRAULIC POWER CONTROL CIRCUIT AND CONSTRUCTION VEHICLE COMPRISING SUCH CIRCUIT

The present invention relates to an hydraulic power control circuit for operation of a plurality of actuators, in particular for construction vehicles, such as loaders, excavators and the like.

BACKGROUND OF THE INVENTION

A construction vehicle is provided with a plurality of actuators that are controlled by an operator. It is known to provide a cost effective control circuit for a construction vehicle using an open center control circuit. However, a proportional control of actuator with an open center technology is not possible. This requires a particularly skilled operator for the construction equipment.

It is also know to provide a construction vehicle with a load sensing control circuit and a relative pump unit. The load sensing technology ensures a proportional control of the actuators, which can be operated simultaneously in order to increase efficiency of the construction vehicle. However a load sensing circuit requires a relatively large number of components because each control spool valve is associated to a pressure compensator. Furthermore a pressure compensator is a relatively expensive hydraulic component.

US2013/220425 discloses a hydraulic circuit with a single pressure compensated orifice controlling flow to two control valves.

It is therefore the scope of the present invention to provide a control circuit that is less expensive than a load sensing one and, at the same time, provide a comparable performance to obtain a relatively easy operation of the actuators.

SUMMARY OF THE INVENTION

The scope of the present invention is achieved with a load sensing hydraulic control circuit wherein a pressure compensator elaborates both a load sensing pressure signal to control a pump unit and an output power flow that is either split or alternatively directed to at least a first and a second actuator control valves so that a differential pressure across the first and second control valves is controlled by the pressure compensator. This provides a sharing of the compensator between first and second control valves.

A construction equipment vehicle may be provided with the control circuit cited above.

Additional features of the invention are comprised in the dependent claims.

BRIEF DESCRIPTION OF THE DRAWINGS

For a better understanding of the present invention, the latter will further be disclosed with reference to the accompanying figures in which.

DETAILED DESCRIPTION OF THE DRAWINGS

Figure 1:
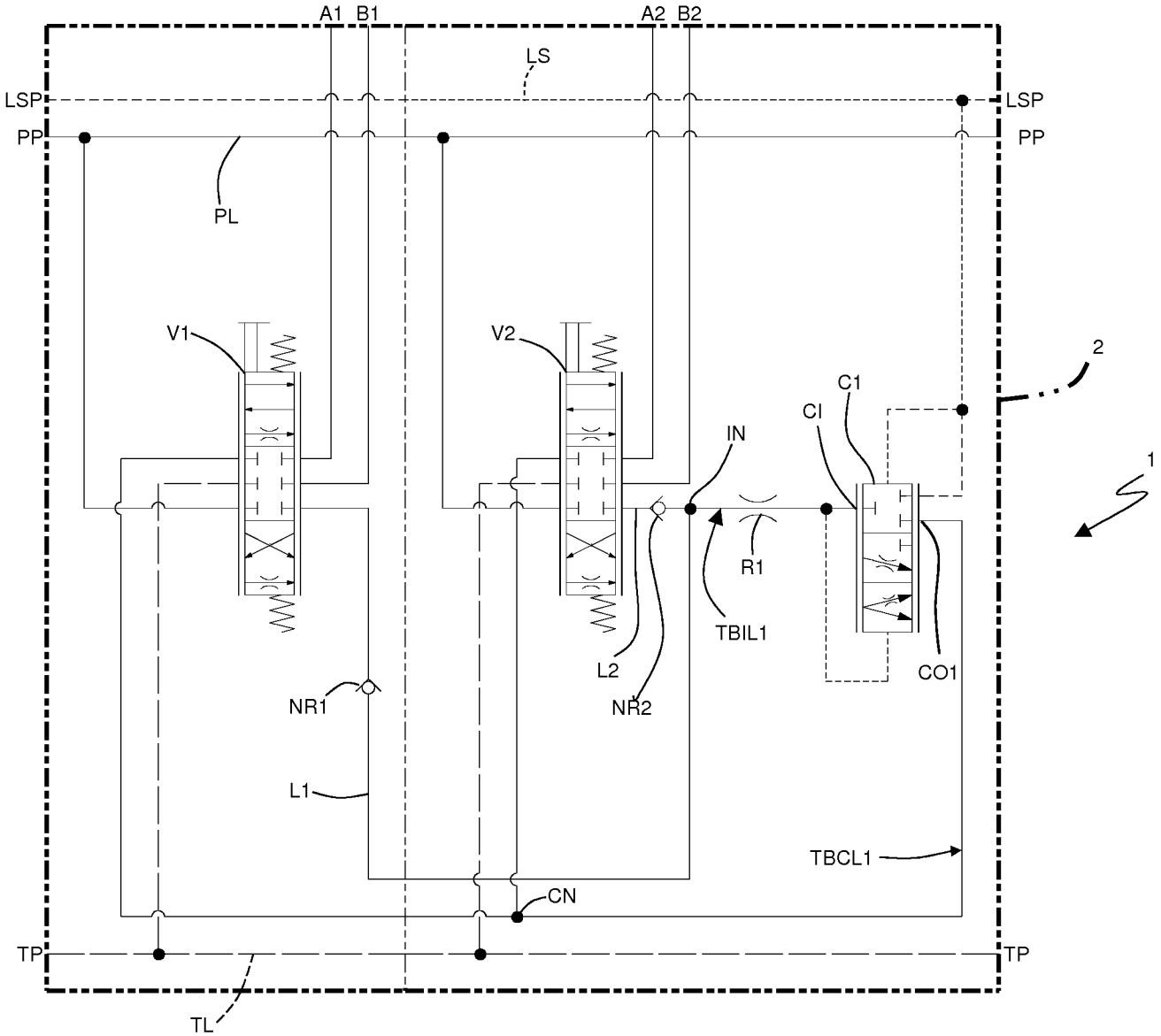
FIG. 1 is a scheme of a control circuit according to a first embodiment of the present invention.

FIG. 1 refers, as a whole, to a load sensing circuit 1 suitable for connection to a load sensing pump unit (not shown) having either a variable displacement and an adjustable spring to set a preferred differential pressure upon a load sensing pressure signal; or a fixed displacement pump and a pump load sensing circuit having a regulating valve to deliver to a tank an excess flow generated by the fixed displacement pump.

Load sensing circuit 1 is connectable to a first actuator and a second actuator, e.g. actuators of a construction vehicle, embodiments of which will be discussed later. In particular circuit 1 comprises a first actuator line A1, B1, and a second actuator line A2, B2, each of which is connectable to a respective actuator.

Circuit 1 comprises pump line PL that is connectable to the load sensing pump unit (not shown) and provides a power flow to circuit 1 in order to control actuators through actuator lines A1, B1, A2, B2.

Circuit 1 also comprises a load sensing line LS to collect a pressure pilot signal from actuator lines A1, B1, A2, B2, and deliver such pilot signal to the load sensing pump unit.

Circuit 1 comprises a tank line TL connectable to a hydraulic tank or sump (not shown) and normally kept at environment or at a selected and low pressure in order to provide a reference low pressure signal.

Circuit 1 is embodied in a control block 2 that is schematically shown in FIG. 1. Block 2 delimits ports that are connected to components not shown in FIG. 1. In particular, block 2 comprises a pump port PP connectable to the pump unit to feed pump line PL, a load sensing port LSP connectable to the load sensing circuit of the pump unit and a tank port TP to connect tank line TL to the tank. Ports of block 2 are preferably disconnectable ports so that block 2 can be mounted/demounted as a whole or in part from a construction vehicle e.g. for inspection and/or maintenance purposes.

According to the embodiment shown in FIG. 1, circuit 1 further comprises a first spool control valve V1 and a second spool control valve V2 to control connection of first and second actuator lines A1, B1, A2, B2 respectively, to pump line PL and tank line TL. In particular first and second control valves V1, V2 control the power flow and, in a working position, move first and second actuators through first and second actuator lines A1, B1, A2, B2 respectively. First and second control valves V1, V2 have a neutral position interrupting flow from pump line PL, i.e. a closed neutral position.

Circuit 1 also comprises a pressure compensator C1 input connected to a T branched compensator inlet line TBIL1. Inlet line TBIL1 is attached to respective outputs of first and second control valves V1, V2 and has an input node IN defining the starting point of a main branch adducting to a compensator input CI the sum of flows coming upstream of input node IN. In view of this, a maximum flow corresponding to the cumulative flow directed to first and second actuator line A1, B1, A2, B2 from pump line PL is elaborated by pressure compensator C1, which is therefore located downstream of first and second control valves V1, V2 along compensator inlet line TBIL1. The latter is connected, through a compensator output CO1, to a T branched compensator output line TBCL1 having a compensator output node CN defining the end of a main branch connected to output CO1. In output node CN the cumulative flow splits into a first flow directed to power the first actuator line A1, B1 for moving the relative actuator and a second flow directed to power the second actuator line A2, B2 for moving the relative actuator. To this regard, compensator output line TBCL1 is attached to first and second control valves V1, V2. In the preferred embodiment of FIG. 1, control valves V1 and V2 meter the flows directed to compensator C1. In particular, flow metering is operated by control valves V1, V2 through a respective calibrated notch of the spool that feeds the inlet line TBIL1. Instead actuator lines A1, B1, A2, B2 are fed by a respective on-off flow adduction, i.e. without calibrated notches.

As shown in FIG. 1, input node IN is where flows coming in parallel through control valves V1 and V2 merge upstream of pressure compensator input C1. To this regard, input node IN is connectable to pump line PL through a first line L1 of inlet line TBIL1 and through a second line L2 of inlet line TBIL1. First and second lines L1, L2 converge into input node IN. Input line TBIL1 is connected to pump line PL through first and second control valves V1, V2 when either first or second or both control valves V1, V2 are in a working position.

Preferably, in order to avoid backflows, first and second lines L1, L2 comprise a respective non-return valve NR1, NR2 that stop flow directed from node IN to the relative control valve V1, V2. The provision of non-return valves NR1, NR2 stabilizes the functioning of circuit 1.

Additionally, in order to safeguard pressure compensator C1 from an excessive flow, a calibrated restrictor R1 processing the power flow entering in pressure compensator C1 is placed between input node IN and compensator input CI.

In use, an operator can either at the same time or alternatively operate first or second control valve V1, V2. When the first or second control valves V1, V2 are operated alternatively, e.g. control valve V1 is operated, compensator C1 is open and the differential pressure across control valve V1 equals the setting of compensator C1. Compensator C1 is shared by first and second control valves in that a single compensator serves two valves operated alternatively. In such a condition, control of an actuator attached to circuit 1 according to FIG. 1 is proportional to the opening of the control valves V1, V2.

When both control valves V1 and V2 are simultaneously operated, the predefined differential pressure is applied to both the control valves, but the greatest part of the power flow directs to actuator having the lower load e.g. control valve V1 and first actuator. Actuator controlled by valve V2 moves slowly until the relative working pressure for actuation becomes, for example equal or lower than that of first actuator. In case of simultaneous operation of first and second control valves V1, V2, flow splits in output node CN depending on the load on first and second actuators, i.e. in case of higher load on the first actuator the higher share of flow will direct towards the second actuator. Therefore a proportional control of actuators can only be achieved when first and second control valves are non-simultaneously operated.

Figure 2:
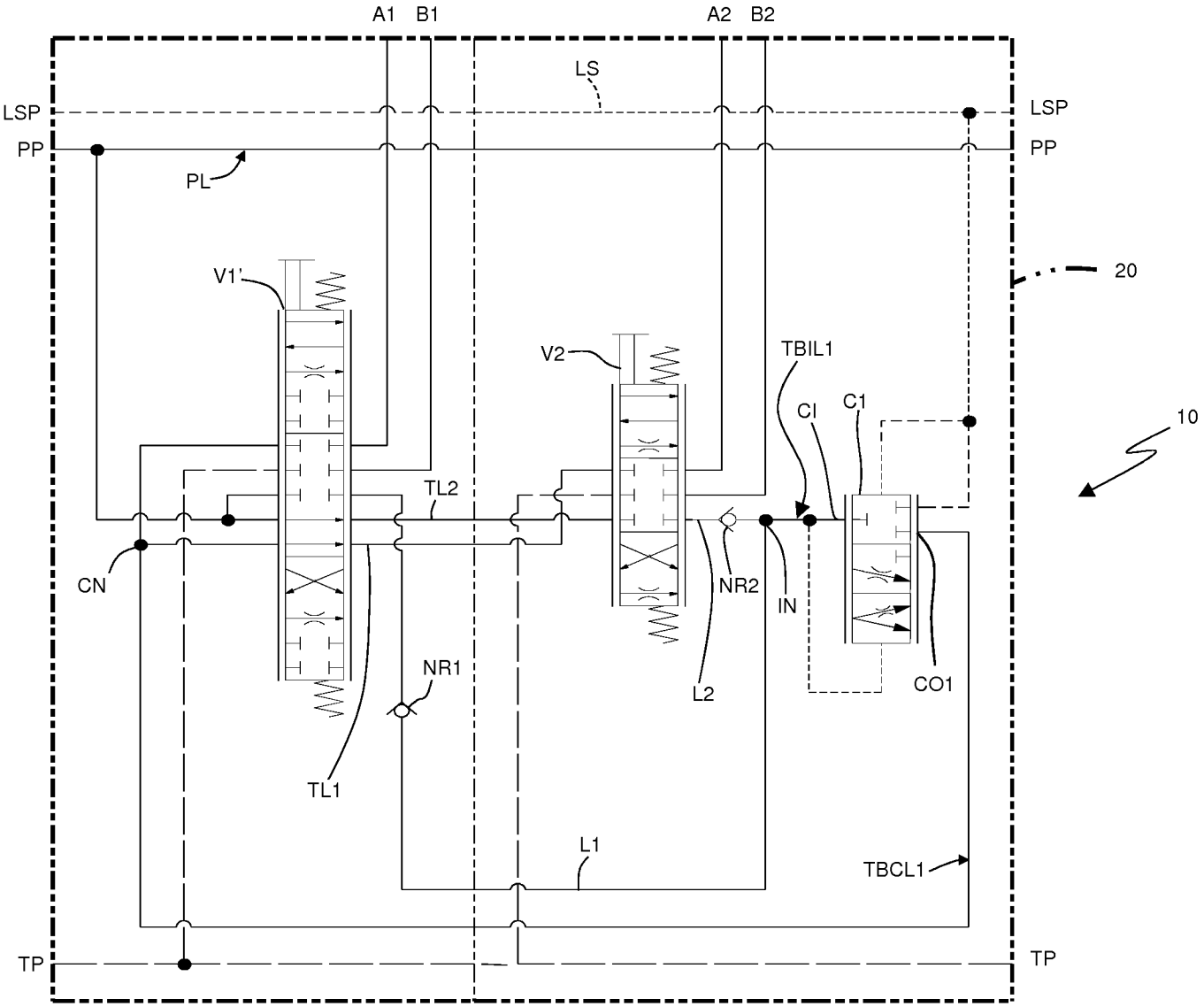
FIGS. 2 and 3 are respective schemes of a control circuit and an expanded control circuit according to a second embodiment of the present invention.

FIG. 2 shows a circuit 10 and control block 20 that represent a second embodiment of the present invention. The description of embodiment in FIG. 2 will be such that elements functionally identical to those of embodiment in FIG. 1 will be indicated below using the same reference numerals adopted in the preceding paragraphs. In particular, embodiment of FIG. 2 differs from the embodiment of FIG. 1 in the following.

First control valve V1' further comprises, with respect to control valve V1, a first and a second neutral through passage along respective first and second valve center through lines TL1, TL2 that are open in a neutral position of first control valve V1' and that, in working positions of first control valve V1', are closed. First valve center through line TL1 is connected to output node CN and second actuator line A2, B2 when first control valve V1' is in neutral position and second control valve V2 is in a working position; second valve center through line TL2 is the connection through which second line L2 of compensator inlet line TBIL1 is connected to pump line PL when first control valve V1' is in neutral position. First and second valve center through lines TL1, TL2 are closed when second control valve V2 is in neutral position.

In use, action of compensator C1 is shared alternatively by first and second control valves V1', V2, namely compensator C1 feeds alternatively valves V1' or V2. Furthermore, first control valve V1' is fed by compensator C1 with an absolute priority, i.e. regardless the position of second control valve V2 or the pressure on first and second actuator lines A1, B1, A2, B2. In particular, when control valve V1' is operated, second actuator line A2, B2 is blocked. In general, according to absolute priority, a control valve always meters the inlet flow to one and only one compensator and in case such compensator is receiving metered flow from other control valves, when the absolute priority valve is operated, flow from other control valves will be stopped and the compensator will receive metered flow from the absolute priority valve.

In view of the fact that compensator C1 processes flow alternatively for actuator valves V1' or V2, power flow in output node CN is not split but more simply directed either to second control valve V2 when first control valve V1' is in neutral position or to first actuator line A1, B1 when first control valve V1' is operated.

Differential pressure across first and second control valves V1', V2 is constant and predefined by the load sensing control unit and compensator C1. Actuators attached to control circuit 10 of FIG. 2 are always proportionally controlled with respect to the opening of the relevant control valve.

Figure 3:
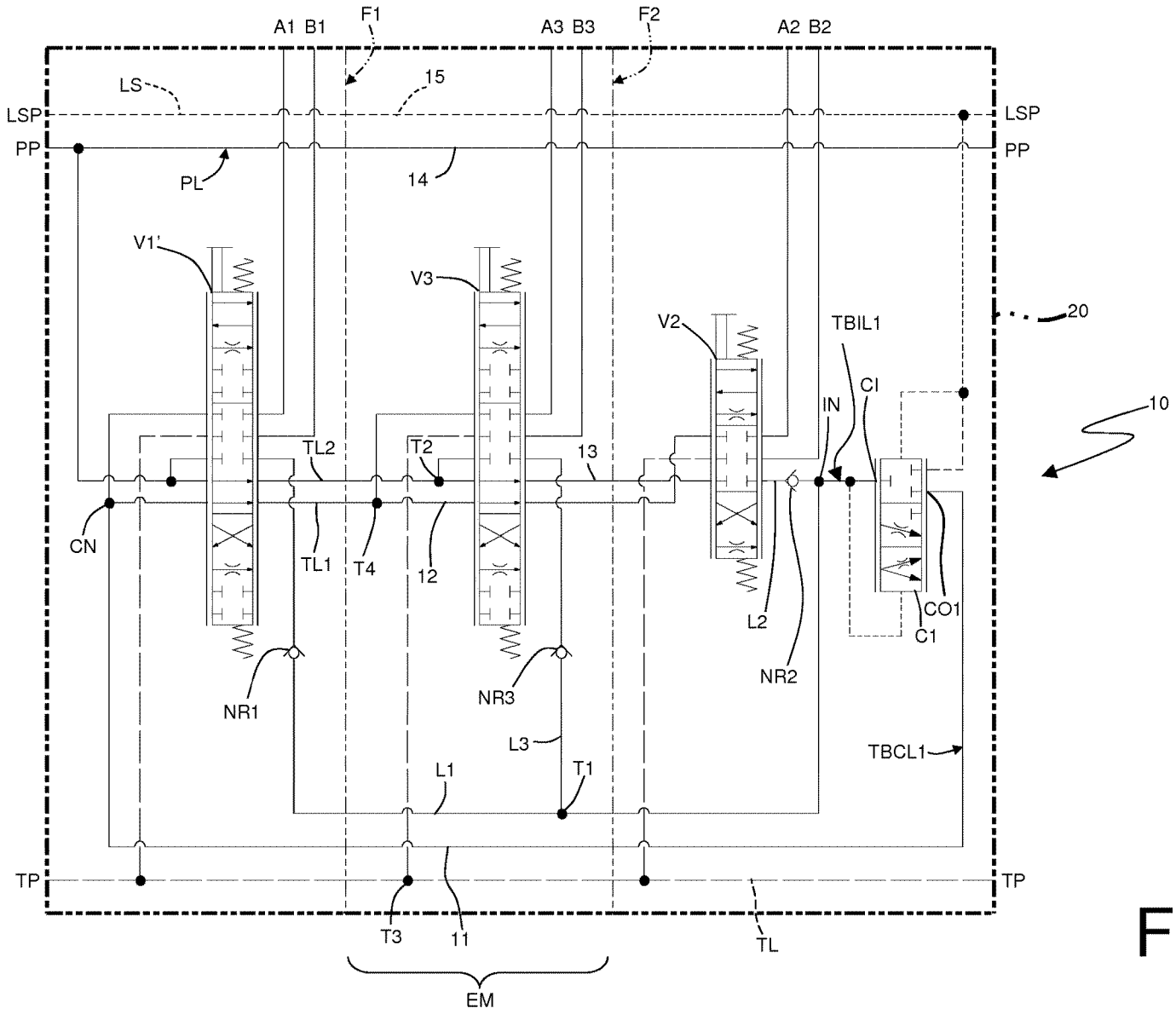

According to the embodiment of FIG. 3 it is possible to expand load sensing circuit 10 by adding one or more third spool control valves V3 identical to first control valve V1' of FIG. 2 and placed between first and second control valves V1', V2. In particular, control valve V3 has a spool identical to that of first control valve V1'. Spool control valves may comprise a valve body providing a number of ports for connection with conduits or pipes that are connected, i.e. welded, threaded or the like, to the valve body. As an alternative, the valve body defines portions of respective ducts so that, in order to assemble block 20, valve bodies are fluidically connected without provision of dedicated intermediate tubes or pipes connected to the valve body. Neutral through passages of third valve V3 are in series to corresponding neutral through passages of first valve V1' by means of valve center through lines TL1, TL2 respectively.

Furthermore, third control valve V3 is such to selectively connect a third actuator line A3, B3 to pump line PL and tank line TL in order to power the motion of a third actuator (not shown).

In particular, third control valve V3 is connected to compensator input node IN through a third line L3. Third line L3 comprises a non return valve NR3 having the same function as NR1 and connected by a T-junction T1 to input node IN. This makes compensator input line TBIL1 of circuit 10 a multi T-branched compensator input line. In general, each additional control valve used to expand circuit 10 according to the teaching of FIG. 3 adds an additional branch with the relative non-return valve to multi T-branched compensator inlet line TBIL1. To this regard, an expansion module EM of circuit 10 comprises a module through conduit 11 as a section of compensator output line TBCL1's main branch, module through conduit 12 as a section of valve center through line TL1 intersecting third control valve V3, module through conduit 13 as a section of valve center through line TL2 intersecting third control valve V3, module through conduit 14 as a section of pump line PL and module through conduit 15 as a section of load sensing line LS. A module through conduit of module EM is such to fluidically connect two opposing connection faces F1, F2 of the module, e.g. of a valve body slidingly housing a control spool and defining the through conduits, so that the block 20 can be assembled comprising a stacking pack of modules EM.

Furthermore, expansion module EM comprises a bypass intercepted by third control valve V3 for connection of conduit 13 to a section of input line TBIL1 through line L3. A T-junction T1 is provided for connection of line L3 to input line TBIL1 and a T-junction T2 is provided for connection of the bypass to conduit 13 across third control valve V3; a T-junction T3 for connection of a through section of tank line TL with third actuator line A3, B3; a T-junction T4 for connection of third actuator line A3, B3 to conduit 12 across third control valve V3; and conduits A3, B3.

In use, an absolute priority to meter power flow for compensator C1 and move first actuator is given to first control valve V1' with respect to the third control valve V3, which is located immediately downstream of first control valve V1' along valve center through lines TL1, TL2 with respect to second control valve V2. Furthermore, third control valve V3 has a higher non-absolute priority to meter power flow for compensator C1 and move third actuator with respect to second control valve V2. More in general, according to the expansion of circuit 10 shown in FIG. 3, each expansion module EM has a priority to receive power flow from compensator C1 over the next downstream expansion module EM along valve center through lines TL1, TL2.

Also in circuit 10 of FIG. 3 the velocity of each actuator is proportional to the opening of the respective control valve V1', V3, V2 and, when necessary, compensator C1 alternatively elaborates the power flow directed to the relative actuator. Therefore, first control valve V1' of circuit 10 is an example of an absolute priority control valve to meter power flow to compensator C1 and thus ensure proportional control of the relative actuator regardless simultaneous switch of either second or third control valve V2, V3. Furthermore, third control valve V3 has a non-absolute priority over second control valve V2 to meter flow to compensator C1. This ensures proportional control of the third actuator regardless the switch of second control valve V2 and subject to switch of first control valve V1', which enjoys absolute priority over compensator C1.

Figure 4:
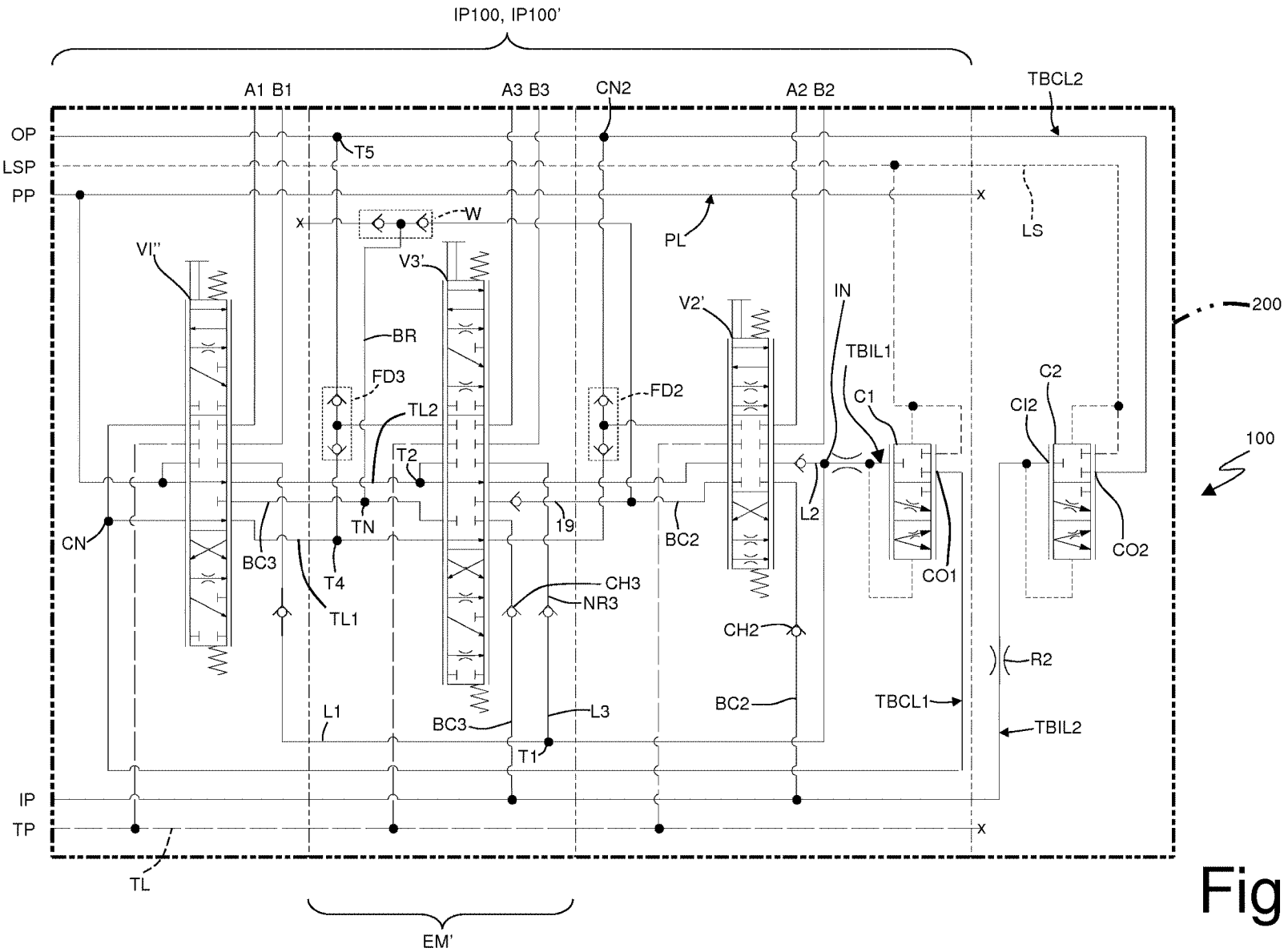
FIG. 4 is a scheme of a control circuit according to a third embodiment of the present invention.

FIG. 4 shows a further embodiment of a load sensing circuit 100 and control block 200. The description of embodiment in FIG. 4 will be such that elements functionally identical to those of embodiments in FIGS. 1 to 3 will be indicated below using the same reference numerals adopted in the preceding paragraphs. In particular, embodiment of FIG. 4 differs from the embodiment of FIG. 3 in the following.

Circuit 100 and block 200 of FIG. 4 comprise an additional pressure compensator C2 having a compensator input CI2 attached by means of a T-branched input line TBIL2 to both second and third control valves V3', V2. In particular, input line TBIL2 comprises respective branches BC2 and BC3 connected to control valves V2 and V3' respectively through check valves CH2, CH3 and parallel connected to CI2. Preferably input line TBIL2 comprises a further branch for connection with an input port IP on block 200. Such further branch is parallel connected to branches BC2, BC3 and expands input line TBIL2 into a multi T-branched feed line. Upstream of compensator input CI12, branch BC2 extends across second control valve V2 and ends attached to third control valve V3' and branch L3 extends across third control valve V3' and ends attached to first control valve V1". Therefore first, second and third control valves V1", V2', V3' differ from the corresponding valves of FIG. 3 by the addition of ports to process fluid along branches BC2, BC3 as defined above. Furthermore circuit 100 comprises a bridge BR to connect branch BC3 between first and third control valves V1", V3' to branch BC2 between second and third control valves V2, V3' in order to bypass third control valve V3'. Downstream of both branches BC2, BC3, input line TBIL2 comprises a restrictor R2 to avoid input overflow to second compensator C2. Second compensator C2 is shared by second and third control valve V2', V3' and not by first control valve V1" because the latter is not attached to the output of compensator C2. Therefore compensator C2 is downstream second and third control valve V2', V3' along input line TBIL2 and, at the same time, disconnected from first control valve V1".

In particular, a power output CO2 of second pressure compensator C2 is connected to a T-branched compensator output line TBCL2 to feed second and third actuator lines A2, B2, A3, B3 through second and third control valves V2', V3'. Output line TBCL2 preferably has a further branch connected to an output port OPon block 200 so that output line TBCL2, in some embodiments, is a multi T-branched output line of second compensator C2.

Preferably output line TBCL2 has a output node CN2 where flow coming from second compensator C2 splits to reach the second and third actuator lines A2, B2, A3, B3. Downstream of output node CN2, each branch of compensator output line TBCL2 is connected to a respective flow deflector FD2, FD3. Each flow deflector FD2, FD3 feeds the relative actuator line A2, B2, A3, B3, with the flow from either second compensator C2 or first valve center through line TL1 to selectively feed second and third actuator lines A2, B2, A3, B3 depending on the case.

In use, contrary to circuit 10, when first control valve V1" is operated in a working position, downstream control valves V3' and V2' remain parallel input connected to pump line PL through bridge BR and terminal section of third branch BC3 in order to selectively feed input line TBIL2 of second compensator C2 when operated in a working position. In particular, bridge line BR is such to feed second control valve V2 also when third control valve V3' is in neutral position.

In case of simultaneous operation of first control valve V1" with another control valve, compensator C1 is prioritized to feed first actuator line A1, B1 and neither second nor third actuator lines A2, B2, A3, B3. This is because first control valve V1", when in a working position, closes second valve center through line TL2 and feeds branch BC3 input line TBIL2 of second compensator C2.

Nevertheless, when alternatively operated, first, second and third control valves V1", V2', V3' share compensator C1 because V1" is not connected to input line TBIL2 of second compensator C2; and input line TBIL2 is not fed when both first and third control valves V1", V3' are in neutral position.

When first control valve V1" is neutral and second and third control valves V2', V3' are operated, both input lines TBIL1 and TBIL2 of respective compensators C1 and C2 are fed so that each control valve V2', V3' is assigned to a respective compensator C1, C2.

When all control valves are simultaneously operated, first control valve V1" is prioritized to feed only compensator C1 so that the first actuator can be controlled in velocity due to the predefined differential pressure regardless the conditions of second and third control valves V2', V3' (absolute priority); and second and third valve V2', V3' share second compensator C2 so that second and third actuators can be controlled by predefined differential pressure in a flow saturation condition, i.e. the predefined differential pressure of C2 is applied to the control valve feeding the actuator with the lower load, i.e. working pressure, first and, then to the other control valve. This is the same functioning of circuit 1.

Furthermore, third control valve V3' enjoys a non-absolute priority to compensator C1 with respect to second control valve V2' so that, when first and third control valves V1" and V3' are neutral, second control valve V2' is associated to compensator C1. However, in case third control valve V3' and second control valve V2' are simultaneously in a working condition, then third control valve is associated to compensator C1 and second control valve V2' meters power flow to compensator C2. This applies when first control valve V1" remains neutral.

Figure 5:
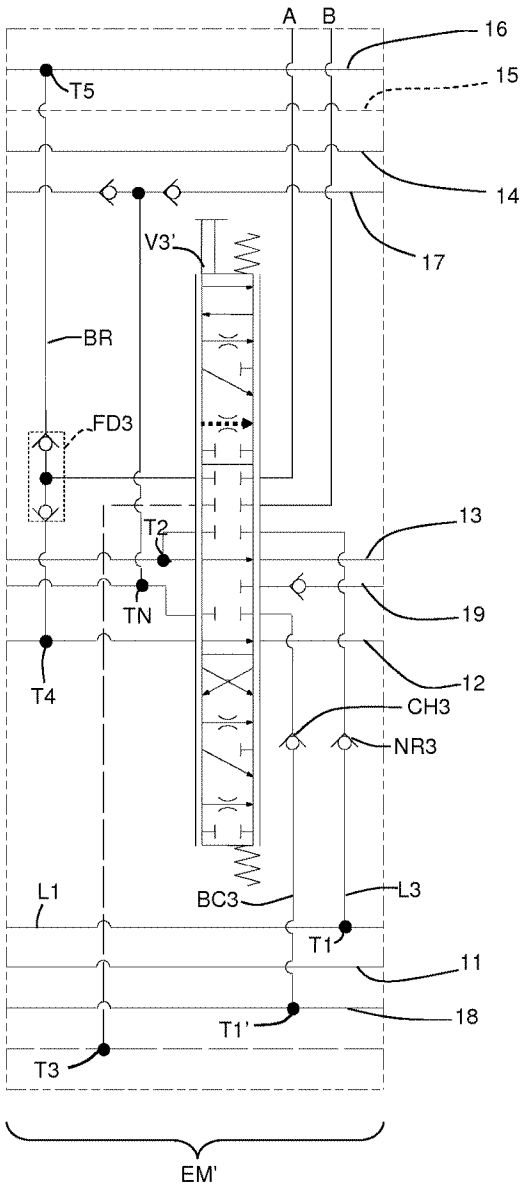
FIG. 5 is a scheme of a sub-unit of control circuit of claim 4.

Circuit 100 is expandable through second expansion module EM' (FIG. 5) that has a valve body defining conduits and comprising check or one way valves such to provide a module that serially expands block 200 in case a fourth or additional actuators are added to share first and second compensators C1, C2. Second expansion module EM', additionally to expansion module EM, includes: a bridge to connect T-junction T4 to a T-junction T5 along a module through conduit 16 of second compensator output line TBCL2; the flow deflector FD3 for connection of T-junctions T4, T5 to actuator line A3, B3 across third control valve V3'; a bridge to connect a module through conduit 17 of bridge BR to a module through conduit 18 of compensator inlet line TBIL2 through branch BC3, such former bridge having a T-node TN for connection to an inlet port of expansion module EM' and third control valve V3' being across the main branch between T-node TN and module through conduit 18; and an output conduit 19 attached between third control valve V3' and an outlet of expansion module EM' for accession to bridge BR and second control valve V2' outside of expansion module EM'. In particular, suitable one-way valves W are placed along bridge BR in order to avoid backflow from conduit 19 when third control valve V3' is in an operating position. Therefore flow from T-node TN bypasses third control valve V3' to reach second control valve V2' in a first direction and cannot backflow in the opposite direction due to one-way valves W.

Figure 6:
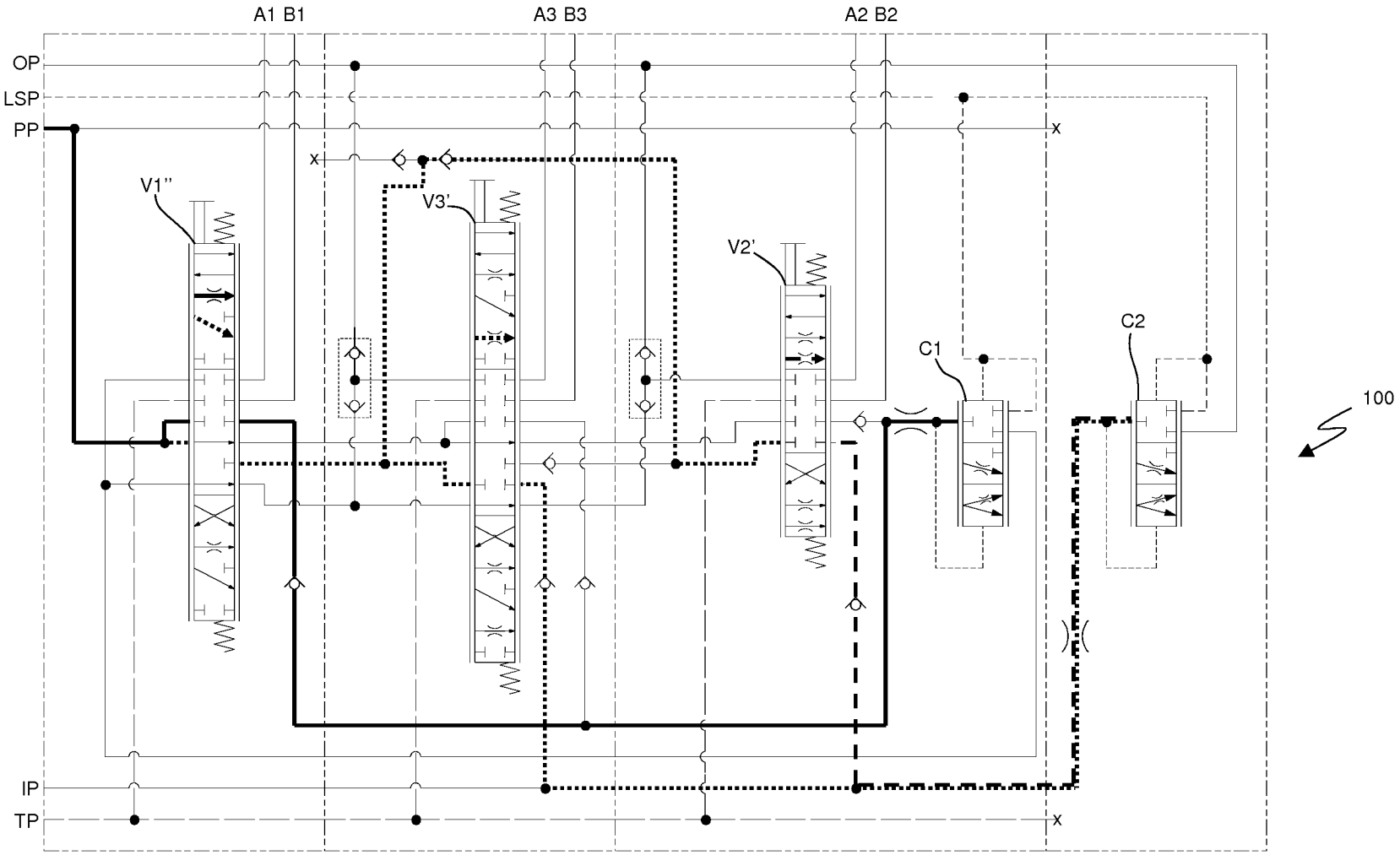
FIG. 6 is a schematic picture of hydraulic fluid flows when circuit of FIG. 4 is in one operating condition.

A schematic view of flows when all three control valves are in a respective working conditions is provided in FIG. 6.

Figure 7:
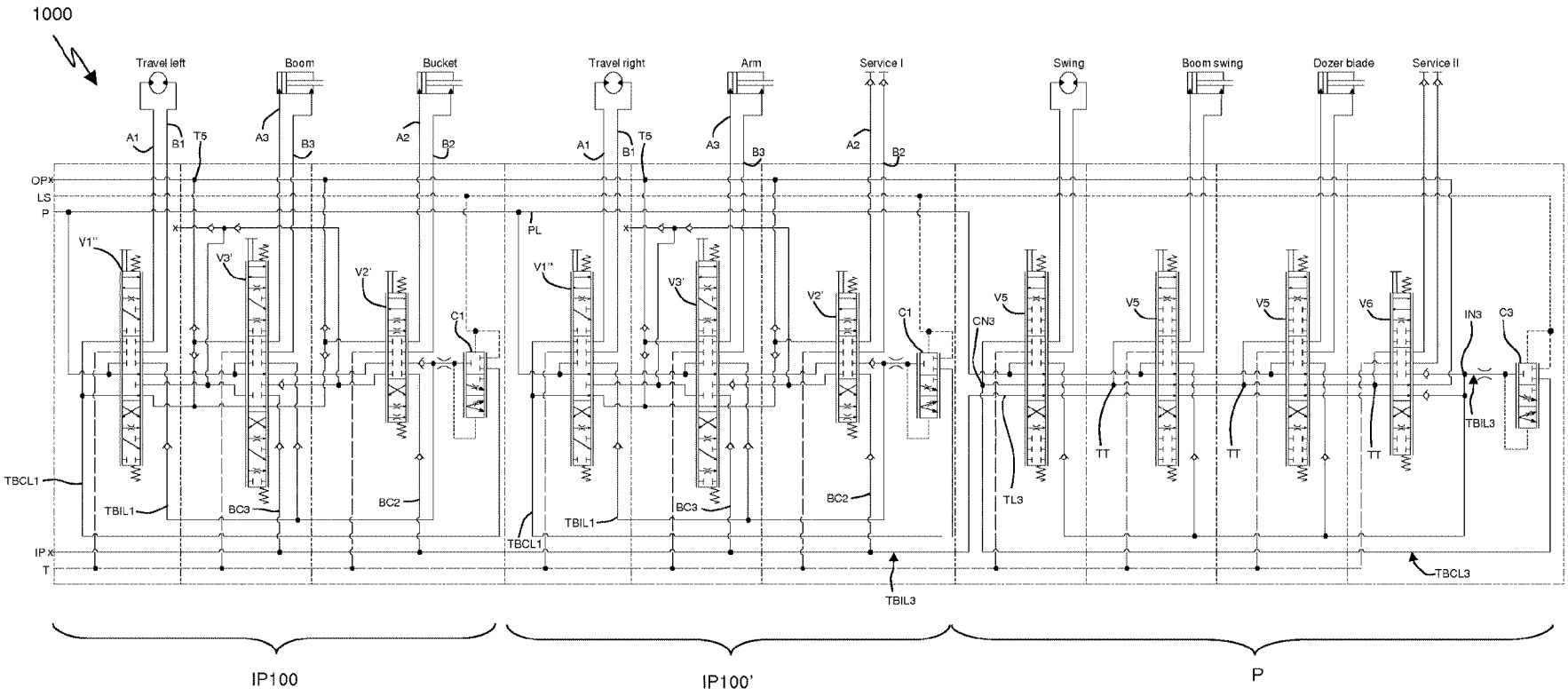
FIG. 7 is a schematic view of a control circuit according to a fourth embodiment of the present invention.

FIG. 7 shows a circuit 1000 that is an expansion of circuit 100 and provided onboard of a construction vehicle to command power actuators. Actuators of construction vehicles are connected to circuit 1000 in order to best optimize the sharing of pressure compensators considering which function does not need to be simultaneous with other ones and which other function, instead, needs to be coupled simultaneously with other ones. In particular, circuit 1000 comprises a first and a second inner packs IP100, IP100' preferably equal to one another and comprising respective first, second, third control valves V1", V2', V3', compensator C1 and multi T-branched input line TBIL1 and T-branched compensator output line TBCL1. In particular inner packs IP100, IP100' are aggregated sub-modules from circuit 100 of FIG. 4.

Circuit 1000 further comprises a pack P having three spool control valves V5 that differ from first and third control valves V1', V3 of FIG. 3 in that a third neutral through passage is present in neutral position. Third neutral through passage is such to connect flow from BC2 and BC3 parallel branches of inner packs IP100, IP100' to a third compensator C3 of pack P by means of a third valve center through line TL3. Therefore third valve center through line TL3 is a main branch of a multi T-branched inlet line TBIL3 that feeds compensator C3. In particular third valve center through line TL3 converges into input node IN3 that, excluding such additional connection, is functionally identical to input node IN of circuit 10, FIG. 3.

Figure 8:
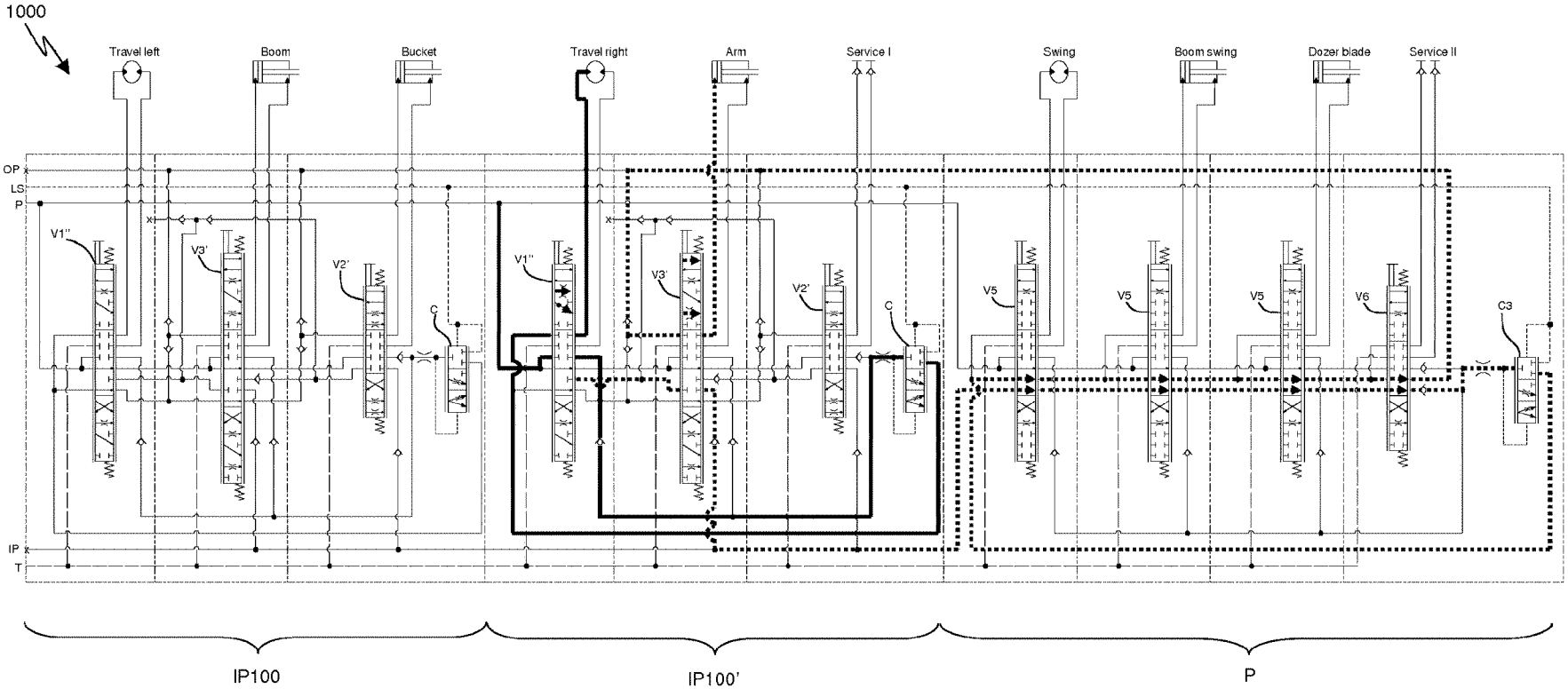
FIG. 8 is a schematic picture of hydraulic fluid flows when circuit of FIG. 6 is in one operating condition.

As a last power control valve upstream of input node IN3 along through line TL3, pack P comprises a control spool valve V6 identical to control valves V1', V3. In its neutral position, control valve V6 closes pump line PL. Furthermore, first neutral through passage of control valve V6 is part of a multi T-branched compensator output line TBCL3 of compensator C3 that when also control valves V5 are in neutral position, reaches second and third actuator lines A2, B2, A3, B3 of inner packs IP100, IP100' (see FIG. 8). This is because compensator output line TBCL3 comprises, downstream of its output node CN3, which functionally corresponds to output nodes CN, CN2, T-junctions TT for connection to actuator lines attached to control valves V5, V6 and T-junctions, e.g. T-junctions T5, for connection with second and third actuator lines of circuits IP100, IP100'. At last, second neutral through passage of valve V6 connects in neutral position through line TL3 of compensator inlet line TBIL3 to input node IN3. According to the connections described above, when control valves of all packs are alternatively operated, they share the compensator C1, C3 of the relative pack. Control valves V5, V6 of pack P cannot be actuated to have simultaneous respective working positions. This functioning is in common with that of circuit 10. Consistently with circuit 10, there is a single control valve V5 with an absolute priority over compensator C3 with respect to other control valves V5 and V6 of pack P as well as with respect to packs IP100, IP100'. Furthermore, remaining control valves V5 and V6 enjoy a non absolute priority over compensator C3, such non-absolute priority prevailing on that of packs IP100, IP100', i.e. in case a control valve from pack IP100, IP100' meters power flow to compensator C3 and one of remaining control valves V5, V6 is operated, the flow to the control valve of pack IP100, IP100' is interrupted.

Furthermore, second and third valves V2', V3' of inner packs IP100, IP100' can share third compensator C3, in case of simultaneous working position of the respective first valve V1" and neutral position of control valves V5, V6 of pack P. When one of control valves V5, V6 is switched in working position, compensator C3 feeds the relative actuator attached to pack P so that actuators attached to pack P take priority for use of compensator C3 over actuators attached to first and second inner packs IP100, IP100'. This is because, through compensator inlet line TBIL3, compensator C3 is downstream to second and third control valves V2', V3' of modules IP100, IP100' and to control valves V5, V6 of module P.

Preferably, the following actuators are onboard of the construction vehicle and attached to circuit 1000: travel left, travel right, bucket, boom, arm, service I, service II, dozer blade, swing and boom swing. In particular swing refers to rotary motion of an upper frame of the construction vehicle with respect to a lower frame to which travel system of the vehicle is attached. Furthermore boom swing refers to an additional rotational degree of freedom of a boom with respect to the lower frame.

A preferred division in sub-groups of the above actuators is:

inner pack IP100: travel left, boom, bucket;

inner pack IP100': travel right, arm, service I;

pack P: swing, boom swing, dozer blade, service II.

Preferably absolute priorities are associated to operation of:

travel left within inner pack IP100;

travel right within inner pack IP100';

swing within pack P.

According to a not-shown embodiment, where there are only two packs having one pressure compensator each, the absolute priority to the use of compensators is respectively assigned to travel left and travel right actuators.

Figure 9:
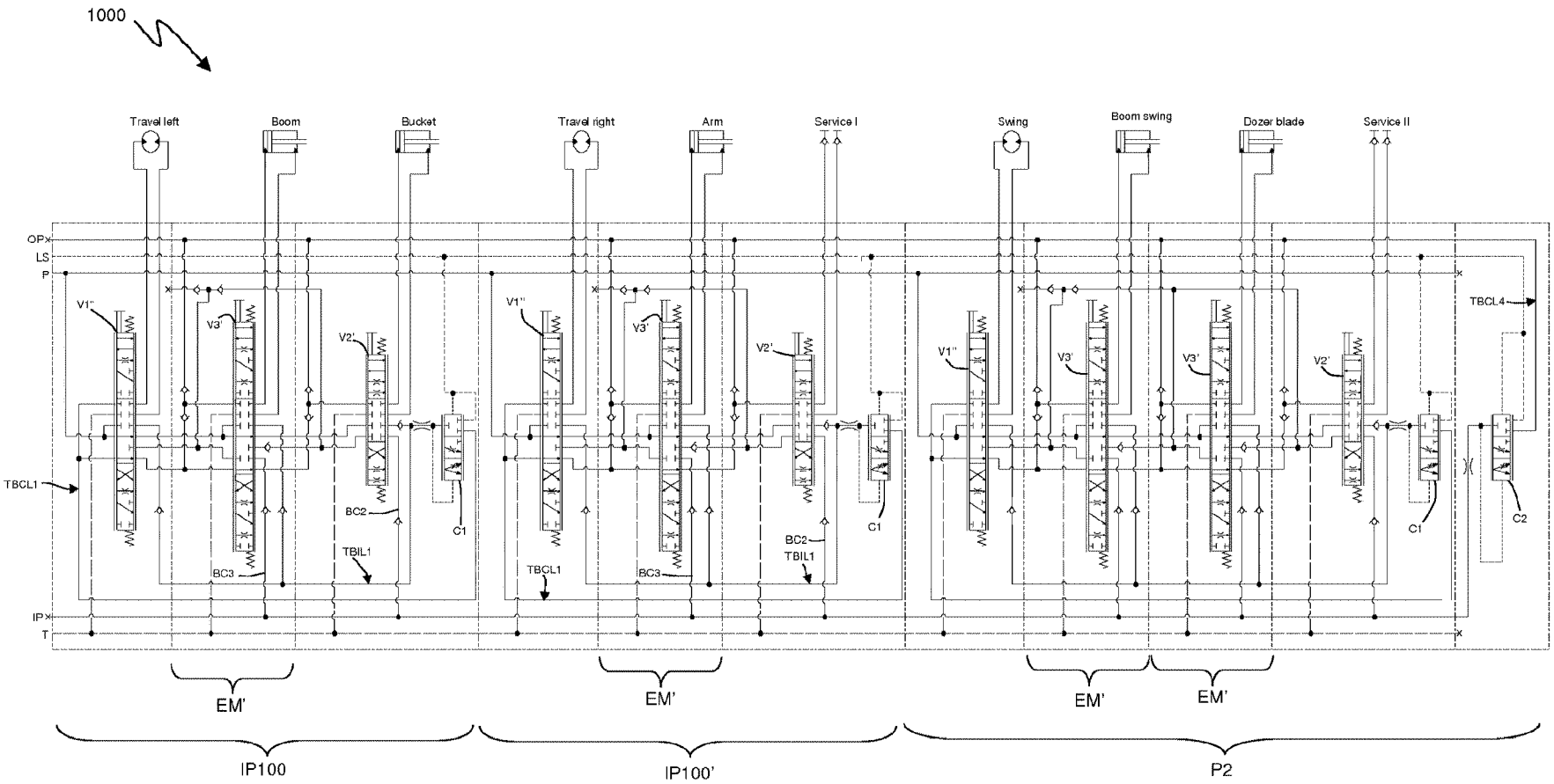
FIG. 9 is a schematic picture of a control circuit according to a fifth embodiment of the present invention.

FIG. 9 is a further embodiment of the present invention comprising two inner packs identical to IP100, IP100' of circuit 1000 and an additional pack P2 that is an expanded circuit 100, i.e. having two control valves V3' and respective expansion modules EM'. In particular, compensator C2 of pack P2 is connected to all control valves but first control valves V1" of the circuit as a whole by means of an extended multi T-branched compensator output line TBCL4. Compensator C2 functions in case a fourth actuator fed by second and third control valves V2', V3' is simultaneously operated to other three actuators.

Figure 10:
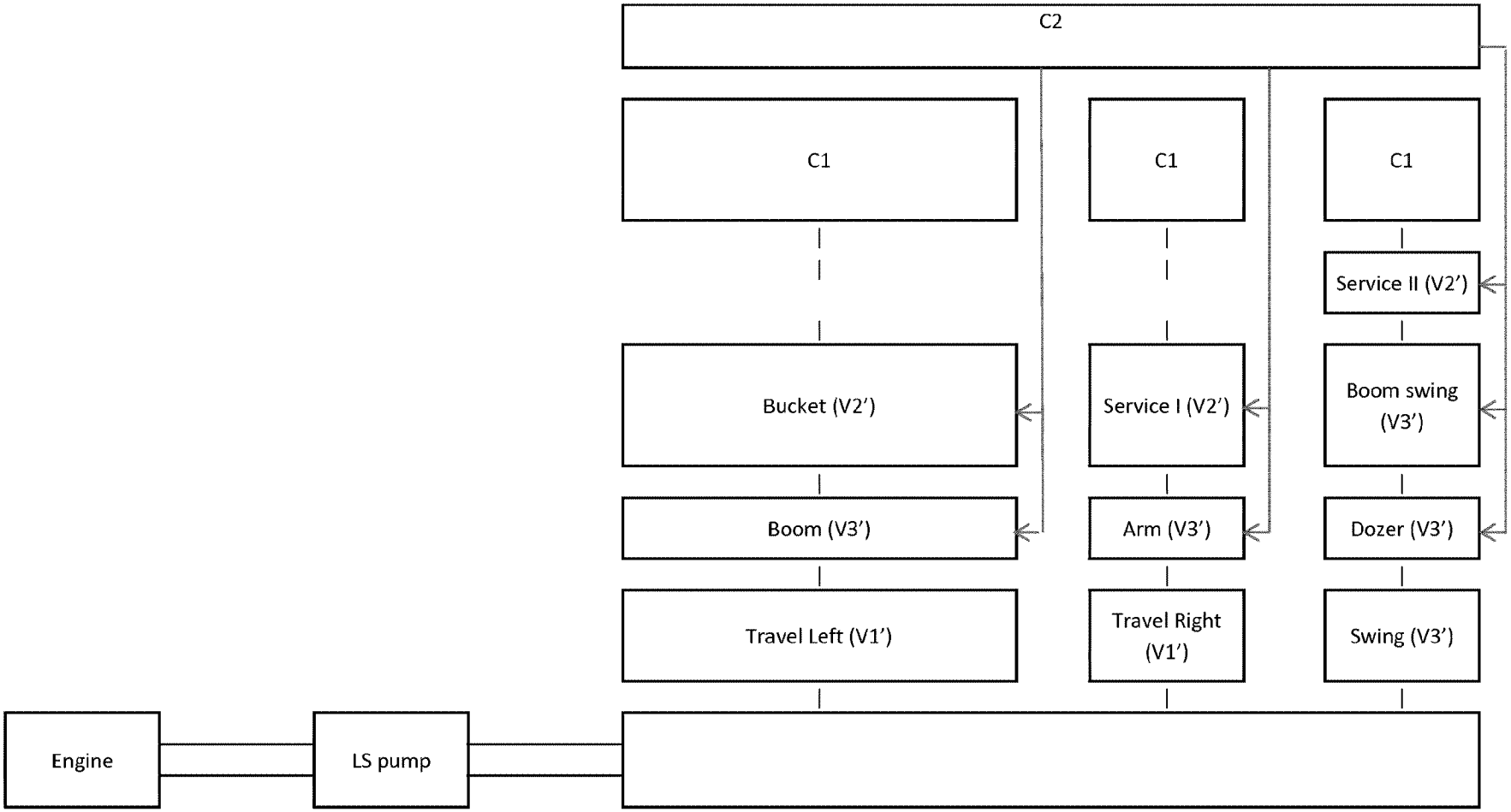
FIG. 10 is a schematic block diagram of the priority association for use of the compensators among the actuators of the circuit in FIG. 9.

FIG. 10 schematically shows the priorities associated to the actuators of FIG. 9. In particular, absolute priority is associated to the following components:

First control valve V1" of travel left and compensator C1 of IP100;

First control valve V1" of travel right and compensator C1 of IP100'; and First control valve V1" of swing and compensator C1 of P2.

Other actuators are given a non-absolute priority over compensator C1 of the respective pack and, in case of simultaneous operation with another control valve of the same pack, compensator C4 takes over the control of the valve that has a lower priority.

The advantages of a hydraulic control circuit according to the present invention are the following.

Sharing of pressure compensators C1, C2, C3 among actuators reduces costs, dimensions and weight of the hydraulic control block 2, 20, 200.

Furthermore, different level of priorities are assignable to the control valves for interaction with the compensators in sharing, namely absolute priority (first control valves of circuits 10, 100, 1000), and non-absolute priority.

The new system is modular providing expansion capabilities through expansion modules EM, EM'. In particular expansion modules EM, EM' comprises valve bodies defining ducts and comprising check or one-way valves such to control additional actuators without requiring to be adapted to the specific actuator. Therefore a block 20, 200 may comprise three or more identical expansion modules EM, EM' depending on the number of actuator to be controlled and powered.

Provision of non-return or check valves in selected locations improves stability of the circuit.

In view of the priorities it is important to have the travel left and right functions to be independent from one another in order to drive the vehicle. Furthermore, when at least boom actuator, arm actuator, bucket actuator, swing actuator, service I actuator and service II actuator, the following groups are preferred in order to guarantee the simultaneous operation of the following functions:

absolute priority: travel left, travel right and swing;

non-absolute priority and in different circuits: service I and boom or bucket; arm and service II.

It was estimated that the following simultaneous operations rendered possible in view of the above combinations, are very common:

travel left and travel right and boom;

travel left and travel right and arm;

travel left and travel right and bucket;

boom, arm and swing;

service I and boom or bucket;

service I and service II.

Finally it is clear that modifications may be made to the control circuit disclosed and shown herein without departing from the scope of protection defined by the appended claims.

When only two circuits are used, the actuators can be grouped as follows:

travel left, boom, bucket, service II;

travel right, arm, swing, service I.

Spool control valves V1, V1, V1", V2, V2', V3, V3', V5 and V6 may be manually controllable (see the figures) or other types of controls such as hydraulic control or electromagnetic control are applicable.

The invention claimed is:

1. A hydraulic control circuit comprising:

a first actuator line for feeding a first hydraulic actuator;

a second actuator line for feeding a second hydraulic actuator;

a pump line connectable to a pump unit and providing power flow for actuation of the first and second actuators;

a tank return line connectable to an hydraulic fluid sump;

a first control valve for controlling the flow to the first hydraulic actuator;

a second control valve for controlling the flow to the second hydraulic actuator;

a load sensing line connectable to the pump unit in order to control the flow delivered by the pump unit to the pump line;

a single pressure compensator for controlling differential pressure across the first and second control valves and having:

a compensator input to receive flow directed to the first and/or second actuator lines; and a first output connected to a T-branched or a multi T-branched compensator output line having an output node in which flow is either split to the first and second control valves or directed to the first control valve or the second control valve to power the first and second actuator lines through the first and second control valves;

a second output connected to the load sensing line; and a T-branched or multi T-branched input line having an input node merging flow from a first line and a second line connected to the first and second control valves respectively to provide a metered flow to the pressure compensator.

2. The circuit according to claim 1, further comprising a non-return valve (NR1, NR2) located along each one of the first and second lines and is closed for a flow from the compensator.

3. The circuit according to claim 2, wherein the first and second control valves are connected in parallel with respect to a pump line input port so that flow from the compensator splits to feed the first and second actuator lines when the first and second control valves are simultaneously operated in a working position.

4. The circuit according to claim 3, wherein the first and second control valves are in series and the first control valve comprises a first "valve center through"-line to connect the output node to the second control valve when the first control valve is in a neutral position; and wherein the second control valve is connected the pump line when the first control valve is in a neutral position by means of a second "valve center through"-line of the first control valve; the first control valve being such to close, in a working position, the first through line so that a predefined differential pressure established by the pressure compensator is applied alternatively across the first or the second control valve with a priority on the first control valve in case the first and second control valves are switched simultaneously.

5. The circuit according to claim 4, further comprising at least an additional control valve connected in series to the first and second control valves along the first and second through lines to feed an additional line from the pump line to the tank return line and having an output connected to the pressure compensator by the multi T-branched input line.

6. The circuit according to claim 5, wherein the multi T-branched input line comprises a third line parallel to the second line with respect to input node and an additional non return valve along third line to stop flow from input node towards the third control valve.

7. The circuit according to claim 6, further comprising an expansion and stackable module having the third control valve, and at least the following through conduits extending between connection faces of the module:

a compensator output line section conduit for connection between the compensator output and the output node through the compensator output line;

a compensator inlet line section conduit having a T-junction with the third line;

a pump line section conduit;

a load sensing line section conduit;

a first valve center and a second valve center through conduit intercepting the third control valve;

the module further comprising a first actuator conduit and a second actuator conduit, a second T-joint for connecting the third line to the second valve center through conduit through the third control valve and a third T-joint for connecting the first valve center through conduit to one of the actuator conduits through the third control valve.

8. A construction vehicle comprising:

at least a first and a second control circuits both according to claim 1, wherein the first control circuit is attached to a travel left actuator and the second control circuit is attached to a travel right actuator so that compensated flow processed by the relative compensator is fed with a highest priority.

9. The circuit according to claim 1, further comprising an additional T-branched or multi-T branched compensator input line connecting in parallel outputs of the first and the third control valves and an additional pressure compensator having:

an additional compensator input connected to the additional input line in order to receive the sum of flows from the first and the third control valves;

an additional compensator output selectively connected to the second and third actuator lines through ad additional T-branched or multi T-branched compensator output line to provide an actuation flow, a flow deflector being provided along the additional compensator output line downstream of the additional compensator output in order to apply an additional predefined differential pressure of the additional pressure compensator across the second and the third control valves in case one of the second and third control valves is switched simultaneously with another of the second and third control valves; and an additional load sensing output connected to the load sensing line.

10. The circuit according to claim 9, wherein the flow detectors are such to connect the second and third actuator lines in parallel with respect to the additional compensator output so that the flow from the additional pressure compensator splits to feed second and third actuator lines when second and third control valves are simultaneously operated in a working position.

11. The circuit of claim 10, further comprising a bridge line to bypass the third valve and connect the second control valve to pump line when the first control valve is in a working position and wherein the second and third lines of the compensator inlet line are closed when the first control valve is in a working position so that the first control valve takes priority to receive flow from the compensator when one of the second and third control valves are simultaneously operated in a working position and, thus, receives flow from the additional compensator.

12. The construction vehicle according to claim 8, further comprising a third control circuit and at least a boom actuator, an arm actuator, a bucket actuator, a swing actuator, a first power actuator, and a second power actuator, and wherein:

the swing actuator is attached to a first control valve of the third control circuit so that the swing actuator is fed by a pressure compensated power flow with a highest priority over other actuators connected to the third control circuit; and a first group of service I and boom or bucket actuators and a second group of arm and service II actuators, are such that, within each of the first and the second groups, relative actuators are each attached to a relative lower priority actuator line sharing the relative pressure compensator with other actuators.

13. The construction vehicle according to claim 8, wherein the first compensator of the second control circuit is also output connected to at least the second control valve of the first control circuit so as to provide a compensated power flow to the second actuator line of first control circuit when the first control valve of third control circuit is in a neutral position.

14. The construction vehicle according to claim 8, wherein the additional pressure compensator is also output connected to at least the second control valve of the first control circuit so as to provide a compensated power flow to the second actuator line of first control circuit at least when two other control valves of the first and second control circuits are in a working position.

* * * * *